United States Patent [19]

Lutz

[11] 4,187,656

[45] Feb. 12, 1980

[54] TACKING STRIP OR RAIL

[76] Inventor: Hermann Lutz, Gartenstrasse 3, 7404 Ofterdingen, Fed. Rep. of Germany

[21] Appl. No.: 868,498

[22] Filed: Jan. 11, 1978

[30] Foreign Application Priority Data

Jan. 13, 1977 [DE] Fed. Rep. of Germany ..... 2701128

[51] Int. Cl.[2] ..... A47G 27/04

[52] U.S. Cl. ..... 52/273; 16/7; 16/16; 294/8.6

[58] Field of Search ..... 52/222, 63, 273; 24/73 VA, 255, 265 C; 16/4, 7, 16; 294/8.6

[56] References Cited

U.S. PATENT DOCUMENTS

| | | | |
|---|---|---|---|
| 324,942 | 8/1885 | Knapp | 16/16 |
| 358,049 | 2/1887 | McCastline | 16/7 |
| 2,258,314 | 10/1941 | Bonnell | 16/16 |
| 4,053,008 | 10/1977 | Baslow | 52/273 |
| 4,054,698 | 10/1977 | Hamrah | 16/7 |
| 4,058,946 | 11/1977 | Habrant | 52/273 |

FOREIGN PATENT DOCUMENTS

| | | | |
|---|---|---|---|
| 323704 | 8/1920 | Fed. Rep. of Germany | 139/380 |
| 2148872 | 5/1973 | Fed. Rep. of Germany | 52/222 |
| 2236071 | 1/1975 | France | 52/222 |
| 857025 | 12/1960 | United Kingdom | 16/7 |

*Primary Examiner*—James A. Leppink
*Assistant Examiner*—Henry E. Raduazo

[57] ABSTRACT

A tacking rail for retaining the border-edge zone of a sheet material under tension. The longitudinal tacking rail has a flat bottom bearing surface and is wedge-shaped in cross-section at one side. A pair of parallel wall members extend oppositely from the wedge in cross-section and define a tensioning groove therebetween which extends substantially along the entire length of the tacking rail. The border-edge zone of the sheet material is adapted to be inserted and wedged into the tensioning groove by means of an auxiliary tool so that it can be retained under tension therein.

8 Claims, 4 Drawing Figures

TACKING STRIP OR RAIL

BACKGROUND OF THE INVENTION

The invention relates to a novel tacking rail or strip having a profiled cross-section which serves to retain and hold the edges of sheet material to be maintained under tension.

Such profiled tacking rails or strips are already known. These known tacking strips or rails generally include a band having tacks projecting therefrom. The edges of the material to be maintained under tension is held by the projecting tacks. However, such tacking strips are only suitable for specially prepared textile materials, that is material which has on the side which is penetrated by the tacks, freely positioned shanks of loops into which the tacks of the tacking strip can engage. If the textile material is not of such a suitable type for engagement with the tacks, the edge of the material must be provided with a special edge band which can coact with the projecting tacks of the tacking rail.

SUMMARY OF THE INVENTION

It is an object of this invention to provide an arrangement for fastening and maintaining under tension sheet material, in particular material suitable for covering walls, which is substantially less costly to manufacture than the aforementioned tacking rails and tacking strips of the state of the art and which can be used with all types of material that are to be maintained under tension, such as, for example, textile materials and carpets. The tacking strip or rail of this invention can maintain the aforementioned material under tension in a secure, and quick manner without requiring any prior preparatory steps.

This object of the invention is attained by means of an arrangement which is characterized by a profiled rail, the cross-section of which includes a wedge-shaped portion to be positioned adjacent to the plane of the material to be tensioned. Adjacent to the wedge-shaped portion, there are two wall members spaced from each other which define therebetween, at the narrow side of the profiled rail, an open tensioning groove. The profiled rail is, at its upper side, advantageously at least partially covered with a strip of self-adhesive material which facilitates the fastening of the sheet material to be tensioned. The tensioning of the textile or foil sheet material is effected, however, in the first place by returning the border or edge zone of the sheet material in the tensioning groove of the tacking rail. The groove advantageously has, in at least one of the wall members defining the groove, a projection which constitutes a type of bridge spaced from the groove opening and which serves to better retain the edge of the textile or foil sheet material.

The profiled tacking rail of this invention which serves to hold sheet material under tension, has the advantage, that a flat and not optically unattractive transition of the material to be tensioned from the plane portion of the sheet material onto the tacking rail occurs by means of its wedge-shaped portion. This wedge-shaped tacking rail can also be used to firmly tension linen sheets. The strips of self-adhesive material which cover at least a portion of the upper side of the profiled tacking rail, anchors all types of woven, knitted or smooth foil-sheet-type material onto the tacking rail along its entire contact surface, so that the sheet material is not retained by point contacts on the tacking rail.

The projection which extends into the tensioning groove of the tacking rail exerts a good clamping action onto the edge or border zones of the sheets to be tensioned. Tensioning of the sheet material can be particularly advantageously effected by means of an auxiliary hand tool having a rigid metal or plastic rod of corkscrew-like configuration extending therefrom, said rod having at its free end a blunt flat point adapted to be inserted into the tensioning groove of the tacking rail. The tensioning groove can be constructed to such a depth that it serves also as storage space for the spare or excess border or edge zone of the sheet which is to be tensioned. By having the lower wall member of the two wall members defining the tensioning groove extend slightly beyond the upper wall member, the tacking rail can be mounted directly against a wall section while the arrangement still maintains a free gap adjacent this wall section through which the forward end of the rod of the auxiliary hand tool for stuffing in the border zones of the sheet material to be tensioned can be introduced.

The tacking rail of this invention can be cheaply manufactured of plastic by means of a conventional rod molding technique. The band of self-adhesive material can also be formed out of a conventional commercially available self-adhesive band material that is mounted on the exterior surface of the upper wall member of the pair of wall members defining the tensioning groove and which preferably is covered by means of a removable protective strip. The self-adhesive band can have a layer of adhesive material on both sides thereof and one of the adhesive sides serves to hold the band onto the upper surface of the tacking rail. The connection between the self-adhesive band and the tacking rail can also be carried out by mechanical connecting means, such as for example clamps or rivets which can either strengthen the connection or constitute the entire connection between the self-adhesive band and the tacking rail.

BRIEF DESCRIPTION OF THE DRAWING

Several forms of construction of the invention are described below and explained in detail by means of the drawing.

In the drawing.

DETAILED DESCRIPTION OF THE DRAWING

Figure 1:
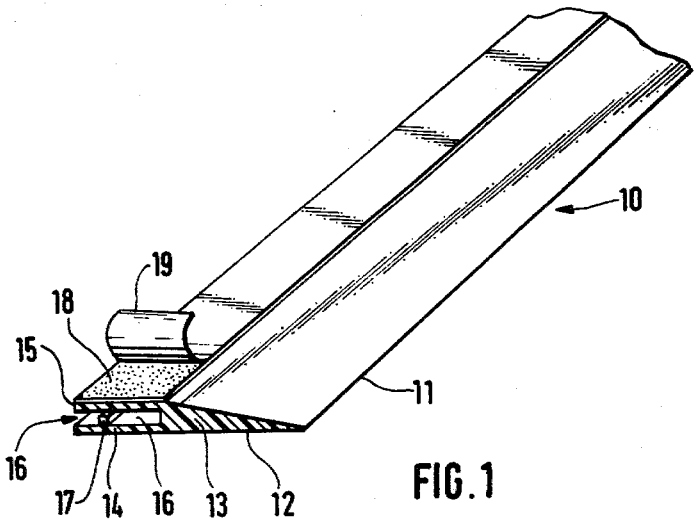
FIG. 1 is a perspective partial view of a first embodiment of the tacking rail of the invention.

There is depicted in FIG. 1 a tacking rail 10 for holding the border-edge zones of a sheet material 22 under tension. The tacking rail 10 has a wedge-shaped portion 13 which terminates at the edge 11 of the tacking rail 10. The lower surface 12 of the tacking rail 10 is flat. At the opposite side from the edge 11 there are provided an upper wall member 15 and a lower wall member 14 which define a tensioning groove 16*a* having an opening 16 for inserting and wedging in the border-edge zone of a sheet material 22 to be tensioned. The outer surface of the lower wall member 14 forms part of the flat support surface 12 of the tacking rail 10. This wall member 14 has a projecting wall portion 17 which extends parallelly and at a distance from the edges defining the opening 16 of the tensioning groove 16*a*. The outer surface of the upper wall member 15 forms a support surface parallel to and spaced from the support surface 12 and is provided with a band 18 having a layer of self-adhesive material which is covered by a removable protective strip 19.

Figure 2:
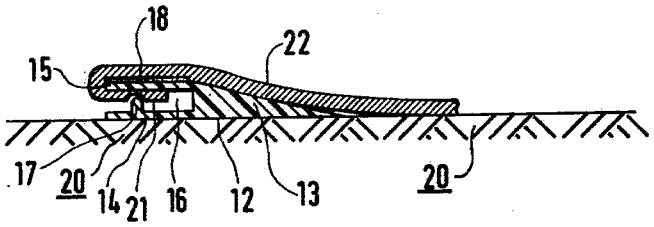
FIG. 2 is a cross-sectional view through the first embodiment of the tacking rail which is depicted as mounted on a base and having a textile material inserted into the tensioning groove thereof.

FIG. 2 illustrates the tacking rail of the invention as mounted on a support floor or wall 20, the flat support surface 12 resting on the surface of the floor wall 20. A border-edge zone 21 of a textile material or plastic foil sheet 22 has been inserted into the tensioning groove 16*a*. The projecting wall portion 17 clamps the border-edge zone 21 of the to be tensioned sheet 22 against the upper wall member 15. Furthermore, the adjacent portion of the border-edge zone of the sheet 22 is glued or otherwise held by the layer of adhesive material of the band or strip 18. As can be noted from FIG. 2 the sheet 22 extends in a stepless manner over the wedge-shaped portion 13 of the tacking rail 10 from the support surface of the floor or wall 20. Consequently, the presence of the tacking rail 10 does not give an optically disturbing appearance in view of the fact that the sheet 22 fully covers the tacking rail 10.

Figure 3:
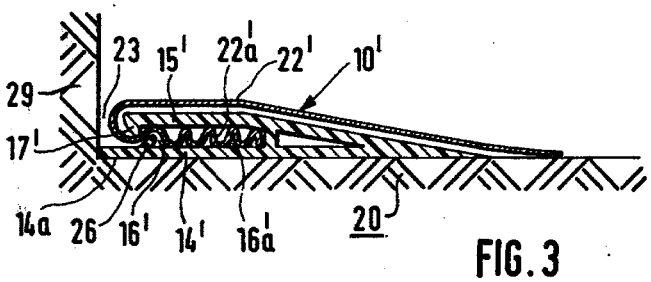
FIG. 3 is a cross-sectional view of a second embodiment of the tacking rail of the invention along the line III—III of FIG. 4 wherein the tacking rail is mounted in the corner of a room.

FIG. 3 illustrates in cross-section a corner formed by the walls 20 and 21 and an alternate embodiment of a tacking rail 10' is mounted. This racking rail 10' differentiates itself from the tacking rail 10 illustrated in FIGS. 1 and 2, by having a lower wall member 14' of greater width than the width of the wall member 14 of tacking rail 10. As can be noted, the lower wall member 14' is of greater width than the upper opposite wall member 15', said wall members 14' and 15' defining the tensioning groove 16'*a*. The portion of the lower wall member 14' which extends beyond the lateral extent of the upper wall member 15' has been labeled 14'*a*. This projecting portion 14'*a* of the lower wall member 14' abuts against the wall surface of the wall 29 and there is formed a gap 23 between the end of the upper wall member 15' and the surface of the wall 29. As can be noted from FIG. 4 the blunt front tip 24*a* of the corkscrew rod 24 of the auxiliary tool 25 can be inserted into the chamber of the tensioning groove 16'*a* via the opening 16' thereof to thereby wedge in the border-edge zone of the sheet material 22' which is to be tensioned. The upper wall member 15' has a hook-shaped projection 17' adjacent to the opening 16' of the tensioning groove 16'*a*. This projection 17' extends parallel to and along the entire edge of the upper wall portion member 15'. The lower wall member 14' also has a projection 26 which extends obliquely into the tensioning groove 16'*a* and extends parallel to the projection 17'. The projections 26 and 17' provide for a particularly efficient clamping action of any material inserted therebetween by means of the auxiliary tool 25.

In order to more clearly illustrate the function of the tacking rail of this invention the sheet material 22' has been depicted by means of a single solid line at a distance from the upper surface of the tacking rail 10'. For similar reasons the band 18 having a layer of self-adhesive material of the tacking rail 10 of FIG. 1 has not been illustrated in the tacking rail 10' of FIG. 3. As can be noted, when comparing the tacking rail 10 of FIG. 1 with the tacking rail 10' of FIG. 3, the tensioning groove 16' is considerably deeper so that there is provided, behind the projections 17' and 26, a storage space within the tensioning groove 16'*a*, in which a reserve portion of the border-edge zone 22'*a* of the sheet 22' to be tensioned can be stored. Such a reserve edge border zone is advantageous because the sheets to be tensioned usually experience, after a cleaning operation, a certain expansion which after newly tensioning the sheet can be compensated for by the reserve border-edge zone 22'*a* being stored in the tensioning groove 16'*a* of the tacking rail 10' of FIG. 3.

Figure 4:
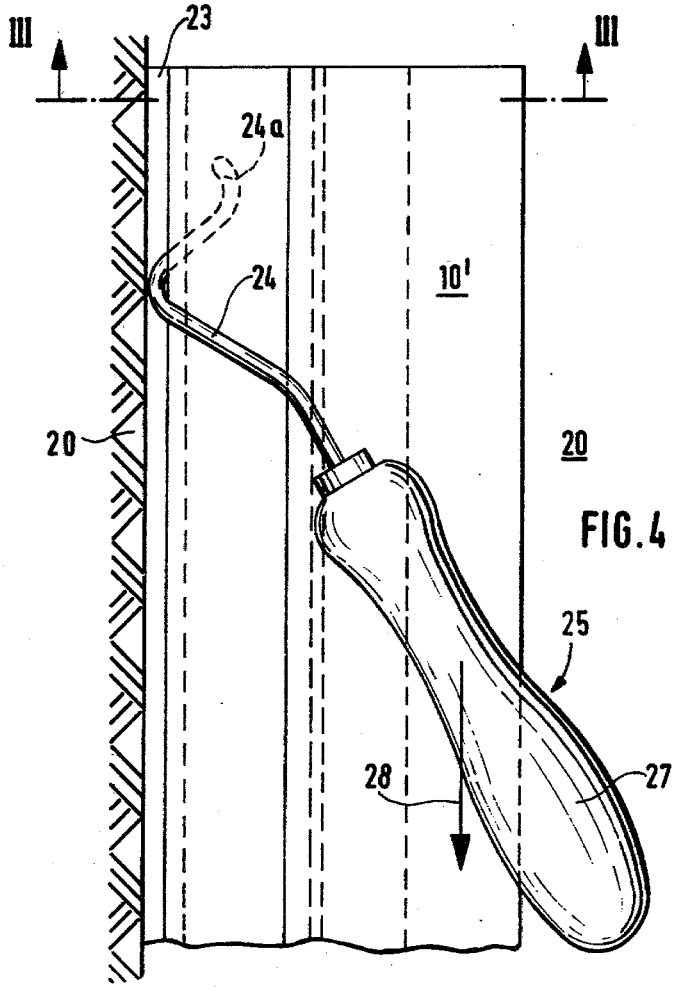
FIG. 4 is a plan view of a portion of the tacking rail according to FIG. 3, wherein the auxiliary tool for inserting and pushing in into the tensioning groove of the tacking rail the border-edge zone of a sheet to be tensioned is also shown.

FIG. 4 illustrates the auxiliary tool 25 for wedging in the border-edge zones of the sheet 22' into the tensioning groove 16'*a*. As can be noted the blunt tip 24*a* of the corkscrew-like rod 24 is inserted through the gap 23 between the wall 21 and the edge of the upper wall portion member 15' into the opening 16' of the tensioning groove 16'*a* of the tacking rail 10'. The border-edge zone 22'*a* of the sheet 22' is inserted and wedged in under tension between the two projections 17' and 26 into the storage space of the tensioning groove 16'*a*. By moving the hand tool 25 in the direction of the arrow 28 as shown in FIG. 4 the free border-edge zone 22'*a* of the sheet 22' is continuously wedged-in along the entire length of the tacking rail 10' into the tensioning groove 16'*a*. The corkscrew-like shape of the inserting rod 24 facilitates a guiding of the hand grip 27 of the auxiliary tool 25 at a distance from both the walls 20 and 29. It is possible and within the scope of this invention to provide hand tools with different curvatures for the inserting rod 24 so that the auxiliary tool 25 can be used in all corners of a room and can be moved in the most advantageous and most easily manipulatable direction from above as well as downwardly.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. The combination of a sheet materail having a border-edge zone and tacking rail adapted to retain the said border-edge zone of the sheet material under tension, the tacking rail comprising:

a longitudinal rail having a flat bearing surface, said longitudinal rail having a characteristic cross-sectional shape, which includes a wedge-shaped region defining one longitudinal edge of said longitudinal rail and of said flat bearing surface;

said characteristic cross-sectional shape also including two parallel wall members extending from said wedge-shaped region, said two wall members defining a tensioning groove therebetween which extends along substantially the entire length of said tacking rail;

a projection extending from at least one of said two parallel wall members into said tensioning groove;

said border-edge zone of said sheet material being positioned over the upper one of said two wall members and inserted and wedged into said tensioning groove so as to completely cover the upper surface of said upper wall member.

2. The combination of a sheet material and tacking rail as set forth in claim 1, wherein at least a portion of the upper surface of said longitudinal rail is covered with a layer of self-adhesive material.

3. The combination of a sheet material and tacking rail as set forth in claim 2, wherein a projection extends from each of said two parallel wall members into said tensioning groove, said projections being offset relative to each other.

4. The combination of a sheet material and tacking rail as set forth in claim 3, wherein at least one of said projections extends substantially along and parallel to the entire length of said tensioning groove.

5. The combination of a sheet material and tacking rail as set forth in claim 4, wherein at least one of said projections extends obliquely from one said wall members towards the bottom of said tensioning groove.

6. The combination of a sheet material and tacking rail as set forth in claim 5, wherein the lower one of said two parallel wall members has a greater lateral width than the other upper wall member, said lower wall member having an outer surface which is coplanar with and forms part of said flat bearing surface.

7. The combination of a sheet material and tacking rail as set forth in claim 5, wherein a storage space for reserve material of said border-edge zone of the sheet material is formed between said obliquely extending projection and the bottom of said tensioning groove.

8. The combination of a sheet material and tacking rail as set forth in claim 2, wherein said layer of self-adhesive material is formed by a band having a layer of self-adhesive material and being connected to at least a portion of said upper surface of said longitudinal rail, and a protective removable strip covering the self-adhesive material.

* * * * *